US007965254B2

(12) United States Patent
Ricks

(10) Patent No.: US 7,965,254 B2
(45) Date of Patent: Jun. 21, 2011

(54) TV SATELLITE DISH STAND

(76) Inventor: Paul C. Ricks, Elbert, CO (US)

( * ) Notice: Subject to any disclaimer, the term of this patent is extended or adjusted under 35 U.S.C. 154(b) by 553 days.

(21) Appl. No.: 11/482,007

(22) Filed: Jul. 6, 2006

(65) Prior Publication Data

US 2008/0007477 A1 Jan. 10, 2008

(51) Int. Cl.
*H01Q 3/02* (2006.01)
*H01Q 15/14* (2006.01)

(52) U.S. Cl. ..... 343/882; 343/912

(58) Field of Classification Search ..... 343/760, 343/878, 882, 894, 912
See application file for complete search history.

(56) References Cited

U.S. PATENT DOCUMENTS

| | | | | |
|---|---|---|---|---|
| 5,526,010 | A | 6/1996 | Plunk | |
| 5,646,638 | A * | 7/1997 | Winegard et al. | 343/882 |
| 5,660,366 | A | 8/1997 | Palmer | |
| 5,870,059 | A * | 2/1999 | Reynolds | 343/760 |
| 5,929,817 | A | 7/1999 | Clark | |
| 5,929,818 | A | 7/1999 | Snyder | |
| 6,124,836 | A | 9/2000 | Rogers | |
| 6,276,649 | B1 * | 8/2001 | Kruse | 248/346.01 |
| 6,404,405 | B2 | 6/2002 | Wanat | |
| 6,682,029 | B1 * | 1/2004 | Dierkes | 248/165 |

* cited by examiner

*Primary Examiner* — Shih-Chao Chen

(57) ABSTRACT

A mount for a satellite dish includes a circular base which has a bubble level system and a plurality of adjustable anchor legs on the base. The base is mounted on the ground and the anchors ensure proper mounting. A collar on the base connects the base to the support post associated with a satellite dish.

3 Claims, 1 Drawing Sheet

TV SATELLITE DISH STAND

TECHNICAL FIELD OF THE INVENTION

The present invention relates to an antenna mount and more particularly to a mount for a satellite dish.

BACKGROUND OF THE INVENTION

Recreational vehicles containing television sets and AM/FM receivers commonly employ separate externally located roof mounted antennas capable of vertical and horizontal adjustment from within the vehicle to permit the antenna to be positioned for optimum signal receiving.

The latest technology in television receiving signals utilize small reflective dishes which are directed toward a stationary satellite, such systems being called Digital Satellite Systems. As such dish type antenna must be pointed toward the satellite transmitter, the dish is, preferably, mounted upon the exterior of a recreational vehicle roof and associated with operating structure internally located wherein the dish may be raised and lowered between travel and operative positions, and may be rotated and tilted to the desired position for optimum signal reception.

Satellite dish systems currently available in the North American markets, especially for use with vehicles such as an RV, are for the most part complex, usually fully automated, utilizing programmed circuitry and motors to rotate, elevate and fix the position of the dish and associated elements in seeking and establishing an optimum position for receiving signals communicated from a selected satellite.

Experience has shown that difficulties have arisen in controlling such automated systems because of the need for properly sequentially implementing the steps required to position the satellite dish and associated elements which steps may vary from manufacturer to manufacturer.

More particularly there is room for error in selecting the requisite switching to energize the motor circuitry and in engaging the locator buttons to fix the position of the dish at any specified time. Moreover, such automated satellite dish systems are usually limited to the reception of signals from one of the many broadcast satellite sources and cannot be readily modified or altered to accommodate the full range. reception of signals from one of the many broadcast satellite sources and cannot be readily modified or altered to accommodate the full range.

Also, many automated satellite systems are costly to manufacture, install and maintain, and for that reason such systems are beyond the budget of many families or households who would appreciate having the option to utilize a more simplified, less expensive yet fully operational satellite dish system for their office, dwelling, home or RV use.

Furthermore, in order to be assured of receiving an adequate signal from a communication satellite, an antenna for the purpose has been securely fitted to a rigid mount which is adjustable in both in azimuth and elevation. Where the antenna is attached to a vehicle the elevation must be adjusted to suit the latitude of the vehicle.

Disadvantageously, such a mount is of its nature bulky and adds to the height of a vehicle on which its mounted. In the case of a recreational vehicle this can limit access to tunnels, bridges, and car parks and the like, and furthermore can have a detrimental effect on the aerodynamics or windage of a vehicle resulting in reduced fuel economy and potentially dangerous handling.

Therefore, there is a need for a means for quickly and reliably mounting a dish for a satellite reception system which can be used in conjunction with an RV and which can be easily and reliably set up and is not overly expensive.

SUMMARY OF THE INVENTION

The above-discussed disadvantages of the prior art are overcome by a mount for a satellite dish which includes a circular base which has a bubble level system and a plurality of adjustable anchors on the base. A collar on the base connects the base to the standard associated with a satellite dish. The mount of the present invention mounts the dish to the ground, and thus is not subject to the disadvantages discussed above with regard to mounts that are on a vehicle, such as an RV or the like.

Using the mount embodying the present invention will permit a user to quickly and easily set up a satellite dish and will maintain that dish in a desired orientation even under the influence of high winds due to the secure anchoring system. Since the dish is mounted on the ground, it can be placed in the most advantageous location and can be made quite stable even in high winds of as much as thirty miles per hour and wind gusts of as much as fifty miles per hour.

Other systems, methods, features, and advantages of the invention will be, or will become, apparent to one with skill in the art upon examination of the following figures and detailed description. It is intended that all such additional systems, methods, features, and advantages be included within this description, be within the scope of the invention, and be protected by the following claims.

BRIEF DESCRIPTION OF THE DRAWING FIGURES

The invention can be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE INVENTION

Figure 2:
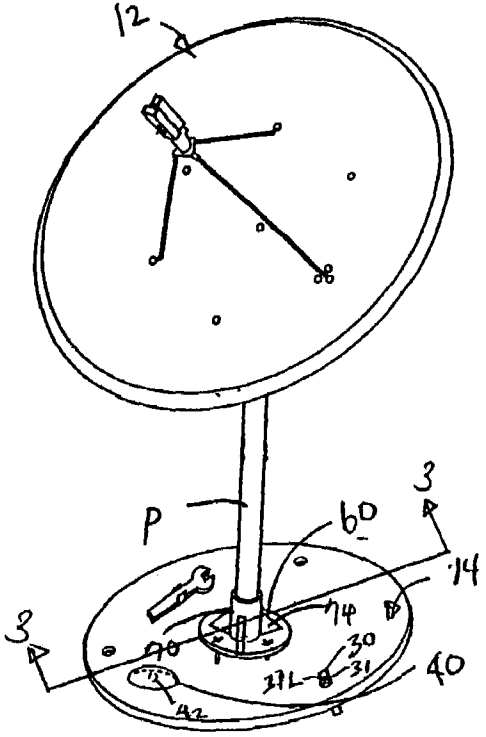
FIG. 2 is a perspective view of a satellite dish mount embodying the present invention in a second position.

Referring to the figures, it can be understood that the present invention is embodied in a mount 10 for a satellite dish 12. Mount 10 comprises a circular main base 14 has a first surface 16 which is concave and which is a top surface when the main base is in use, a second surface 18 which is convex and which is a bottom surface when the main base is in use and a circular outer perimeter 20 so the first surface of the main base has a center 22. Three anchor legs, such as leg 30, include external threads, such as external threads 31 on leg 30, and are each threadably mounted on the main base by internally threaded bores, such as bores 32, 34 and 36. The bores, and hence the legs, are circumferentially spaced apart from each other and extend from the main base and are adapted to mount the main base to a supporting surface such as the ground or the like. The anchor legs are threadably mounted on the main dish so they can be rotated in and out of the main base. Locking elements, such as lock nut 31L or the like, on the legs can be used to ensure that once set, the legs will not move with respect to the main base. In this manner, the orientation of the main base can be altered by screwing the anchor legs into or out of the main base. The three legs act as a tripod support for securely and consistently mounting a satellite dish.

A bubble level unit 40 is mounted on first surface 16 of the main base and includes a bubble 42 which indicates whether or not the main base is level. A tool mount 50 is mounted on the first surface of the main base to mount tools such as a wrench W or the like which can be used to assemble and dis-assemble mount 10. Wrench W is used to turn the anchor legs to adjust the orientation of the main base as will be understood from the teaching of this disclosure.

An anchor element 60 is fixedly mounted on first surface 16 of the main base near center 22. The anchor element includes a circular base 62 which has a first surface 64 which is convex and which is curved to snugly mount on concave first surface 16 of the main base. Fastening elements 66 fasten anchor element 60 to the main base when the anchor element is mounted on the main base.

Figure 1:
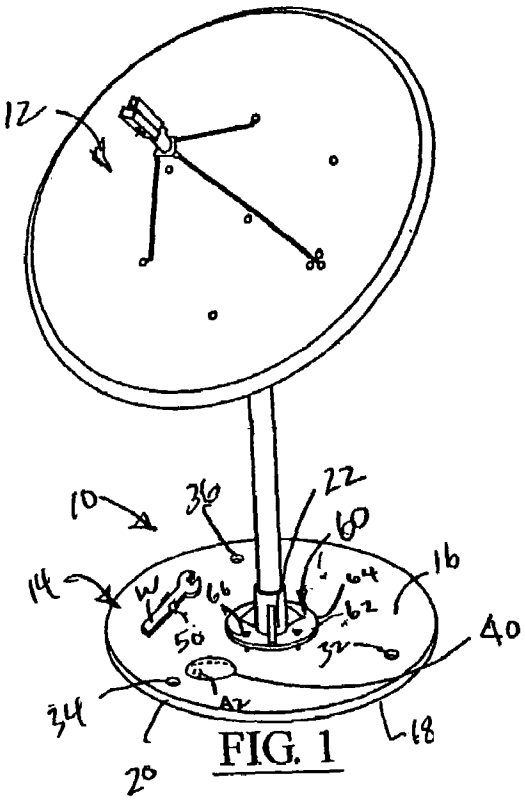
FIG. 1 is a perspective view of a satellite dish mount embodying the present invention in one position.
Figure 3:
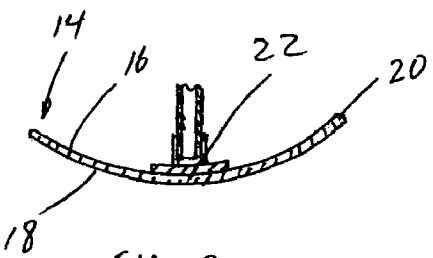
FIG. 3 shows a cross-sectional view along the line 3-3 of FIG. 2.

A tubular support sleeve 70 is fixed to circular base 62 of the anchor element. Tubular support sleeve 70 is sized and shaped to accommodate a post P of satellite dish 12. Buttresses, such as buttress 74, support tubular support sleeve 70 on circular base 62 of the anchor element. Use of mount 10 can be understood from the teaching of the present disclosure and thus will be only briefly discussed. The main base is mounted on a support, such as the ground, using the anchor legs, with the convex surface being located adjacent to the ground, and is re-oriented by moving the anchor legs by threading and unthreading the anchor legs until the main base is level, as can be understood by comparing FIGS. 1 and, especially the bubble 42 of the level. Once the main base is level, a support post of a satellite dish is placed in the tubular sleeve element to support the satellite dish on the main base. The satellite dish can be oriented and positioned for the best reception using mount 10.

While various embodiments of the invention have been described, it will be apparent to those of ordinary skill in the art that many more embodiments and implementations are possible within the scope of this invention. Accordingly, the invention is not to be restricted except in light of the attached claims and their equivalents.

What is claimed is:

1. A mount for a satellite dish comprising:

A) a circular main base having
  (1) a first surface which is concave and which is a top surface when the main base is in use,
  (2) a second surface which is convex and which is a bottom surface when the main base is in use,
  (3) a circular outer perimeter so the first surface of the main base has a center, and
  (4) three mounting holes defined through the main base, the mounting holes being spaced apart from each other circumferentially about the main base, each mounting hole having an internal thread defined on the main base adjacent thereto;

B) three anchor legs, each leg being threadably mounted on the main base and including an external thread which is threadably accommodated by the internal threads on the main base adjacent to a mounting hole associated therewith when the leg is mounted on the main base, the legs being circumferentially spaced apart from each other and extending from the main base, the legs being adapted to mount the main base to a supporting surface;

C) a bubble level unit mounted on the first surface of the main base;

D) a tool mount on the first surface of the main base; and

E) an anchor element fixedly mounted on the first surface of the main base near the center of the first surface of the main base, the anchor element including
  (1) a circular base having a first surface which is convex and which is curved to snugly mount on the concave first surface of the main base,
  (2) fastening elements fastening the anchor element to the main base when the anchor element is mounted on the main base,
  (3) a tubular support sleeve fixed to the circular base of the anchor element, the tubular support sleeve being sized and shaped to accommodate a post of the satellite dish, and
  (4) buttresses supporting the tubular support sleeve on the circular base of the anchor element.

2. A mount for a satellite dish comprising:

A) a circular main base having
  (1) a first surface which is concave and which is a top surface when the main base is in use,
  (2) a second surface which is convex and which is a bottom surface when the main base is in use, and
  (3) a circular outer perimeter so the first surface of the main base has a center;

B) three anchor legs threadably mounted to the circular main base, the legs being adapted to mount the main base to a supporting surface;

C) a bubble level unit mounted on the main base; and

D) an anchor element fixedly mounted on the center of the main base, the anchor element including a tubular support sleeve, the tubular support sleeve being sized and shaped to accommodate a post of the satellite dish.

3. A mount for a satellite dish comprising:

A) a main base having
  (1) a first surface which is concave and which is a top surface when the main base is in use,
  (2) a second surface which is convex and which is a bottom surface when the main base is in use,
  (3) a center, and
  (4) three mounting holes defined through the main base, the mounting holes being spaced apart from each other circumferentially about the main base, each mounting hole having an internal thread defined on the main base adjacent thereto;

B) three anchor legs, each leg being threadably mounted on the main base and including an external thread which is threadably accommodated by the internal threads on the main base adjacent to a mounting hole associated therewith when the leg is mounted on the main base, the legs being circumferentially spaced apart from each other and extending from the main base, the legs being adapted to mount the main base to a supporting surface;

C) a bubble level unit mounted on the first surface of the main base;

D) a tool mount on the first surface of the main base; and

E) an anchor element fixedly mounted on the first surface of the main base near the center of the first surface of the main base, the anchor element including
  (1) a base having a first surface which is convex and which is curved to snugly mount on the concave first surface of the main base, and
  (2) fastening elements fastening the anchor element to the main base when the anchor element is mounted on the main base.

* * * * *